US009251766B2

(12) United States Patent
Baioura et al.

(10) Patent No.: US 9,251,766 B2
(45) Date of Patent: Feb. 2, 2016

(54) COMPOSING STEREO 3D WINDOWED CONTENT

(75) Inventors: Andrei Baioura, Redmond, WA (US); Reiner Fink, Mercer Island, WA (US); Deepali Bhagvat, Redmond, WA (US); Daniel Wood, Seattle, WA (US); Max McMullen, Redmond, WA (US); Mohamed Sadek, Sammamish, WA (US); Ameet Chitre, Bellevue, WA (US); Mary Luo, Redmond, WA (US); Alice Tang, Seattle, WA (US)

(73) Assignee: MICROSOFT TECHNOLOGY LICENSING, LLC., Redmond, WA (US)

( * ) Notice: Subject to any disclaimer, the term of this patent is extended or adjusted under 35 U.S.C. 154(b) by 856 days.

(21) Appl. No.: 13/196,912

(22) Filed: Aug. 3, 2011

(65) Prior Publication Data

US 2013/0033511 A1 Feb. 7, 2013

(51) Int. Cl.

| | |
|---|---|
| ***G09G 5/36*** | (2006.01) |
| ***G09G 5/397*** | (2006.01) |
| ***G09G 5/14*** | (2006.01) |
| *G09G 3/00* | (2006.01) |

(52) U.S. Cl.

CPC ..... *G09G 5/397* (2013.01); *G09G 5/14* (2013.01); *G09G 3/003* (2013.01); *G09G 5/36* (2013.01)

(58) Field of Classification Search

None

See application file for complete search history.

(56) References Cited

U.S. PATENT DOCUMENTS

| | | | | |
|---|---|---|---|---|
| 2006/0164411 | A1 | 7/2006 | Lee | |
| 2008/0088644 | A1 * | 4/2008 | Paquette | 345/634 |
| 2008/0309666 | A1 | 12/2008 | Chen et al. | |
| 2009/0210482 | A1 * | 8/2009 | Wynn et al. | 709/203 |
| 2009/0309808 | A1 * | 12/2009 | Swingler | 345/1.3 |
| 2010/0123729 | A1 * | 5/2010 | Stam | 345/545 |
| 2010/0142931 | A1 * | 6/2010 | Tran et al. | 386/131 |
| 2010/0207971 | A1 * | 8/2010 | Nason et al. | 345/698 |
| 2011/0069150 | A1 | 3/2011 | Cole et al. | |
| 2011/0072389 | A1 * | 3/2011 | Brunner et al. | 715/785 |
| 2011/0096153 | A1 * | 4/2011 | Kobayashi | 348/51 |

OTHER PUBLICATIONS

Akenine-Moller, et al., "Graphics Processing Units for Handhelds", Retrieved at <<http://ieeexplore.ieee.org/stamp/stamp.jsp?tp=&arnumber=4483498>>, In the Proceedings of the IEEE, vol. 96, No. 5, May 2008, pp. 779-789.

Liao, et al., "The Design and Application of High-Resolution 3d Stereoscopic Graphics Display on PC", Retrieved at <<http://wscg.zcu.cz/wscg2000/Papers_2000/R5.pdf>>, Jun. 23, 2007 pp. 7.

Bourke, Paul, "3D Stereo Rendering Using OpenGL (and GLUT)", Retrieved at <<http://www.tav.net/3d/3d_stereo.htm>>, Retrieved Date: Apr. 27, 2011, pp. 5.

"Understanding Direct3D 10 Application Code", Retrieved at <<http://www.codeproject.com/KB/directx/GPU.aspx?display=Mobile>>, Retrieved Date: Apr. 27, 2011, pp. 47.

* cited by examiner

*Primary Examiner* — Kate Luo

(74) *Attorney, Agent, or Firm* — Timothy Churna; Kate Drakos; Micky Minhas

(57) ABSTRACT

A technique for generating content for a stereo 3D display buffer having both stereo 3D graphic objects and non-stereo 3D graphic objects that may be utilized to render stereo 3D content onto one or more windows of a display. The technique incorporates content from stereo 3D application frame buffers into a composition tree that represents the graphic objects in each window displayed on a computing device. At each refresh cycle, the composition tree is traversed to generate content for a stereo 3D display buffer that is then used to draw one or more windows onto a display.

20 Claims, 9 Drawing Sheets

164

COMPOSING STEREO 3D WINDOWED CONTENT

BACKGROUND

The proliferation of stereographic ("stereo") 3D content has created an interest in generating new technologies to provide a user with a richer visual experience. There are stereo 3D displays available that enable users to watch movies, play video games, and/or view stereo 3D content having real time 3D animation and effects. Personal computing devices have the potential to make the most use of stereo 3D technologies since a personal computing device can generate, display, and playback stereo 3D content. An application running on a personal computing device may have the ability to create stereo 3D content and to display the stereo 3D content on a stereo 3D capable display. The personal computing device also has media playback capabilities enabling it to playback stereo 3D content from devices connected to it that can render 3D stereo content. However, the ability of a personal computing device to achieve these capabilities relies on a mechanism to coordinate and perform these functions in a practical and efficient manner.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A desktop composition system has the capability of composing a stereo 3D display buffer including mono content and/or stereo 3D content that may be rendered onto a display in one or more windows. A mono application generates mono content that is written into a mono application frame buffer. A stereo 3D application generates content that is written to a stereo 3D application frame buffer consisting of a left and right frame buffer. The desktop composition system represents the content from the application frame buffers using a composition tree. The composition tree contains a node for each window which points to each application's respective frame buffer and related metadata. At each refresh cycle, the composition tree is traversed to compose the contents from each application's respective frame buffer into a stereo 3D display buffer.

In an embodiment, the desktop composition system composes a stereo 3D display buffer in a manner that minimizes memory consumption and power utilization. The desktop composition system traverses the composition tree in a first pass to compose a left display buffer, to determine if there is any stereo 3D content, and to identify dirty rectangles when stereo 3D content is present. Upon completion of the first pass, if there is no stereo 3D content and temporary mono mode is supported, a temporary mono flag may be set that notifies the underlying hardware to ignore the right display buffer and the second pass is skipped. If temporary mono mode is not supported and there is no stereo 3D content, the dirty rectangles contributed by the mono content is copied to the right display buffer and the second pass is skipped. A second pass of the composition tree is made when the composition tree contains stereo 3D content and the right display buffer is composed considering the dirty rectangles.

These and other features and advantages will be apparent from a reading of the following detailed description and a review of the associated drawings. It is to be understood that both the foregoing general description and the following detailed description are explanatory only and are not restrictive of aspects as claimed.

DETAILED DESCRIPTION

Figure 1:
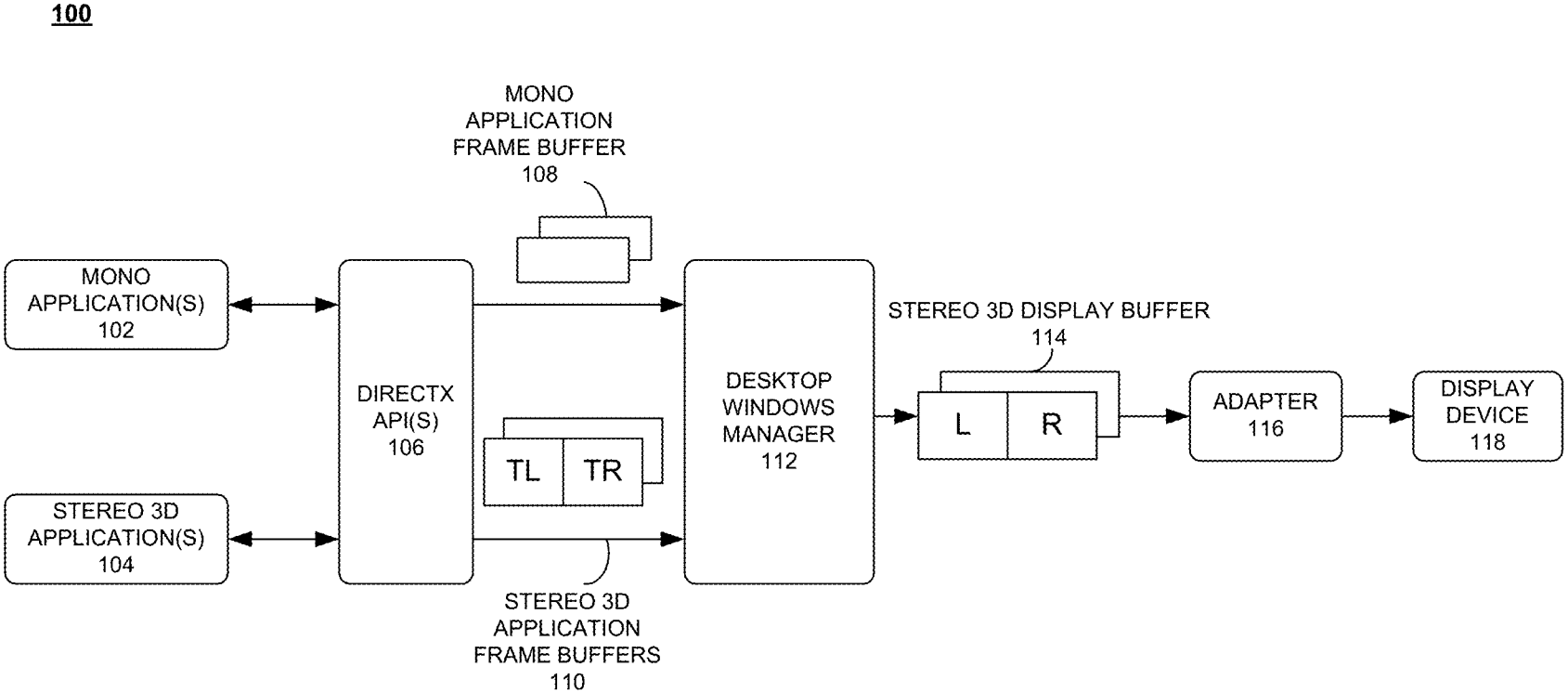
FIG. 1 illustrates a block diagram of an exemplary system for composing stereo 3D windowed content.

Various embodiments are directed to a technology for composing stereo 3D windowed content. In an embodiment, a desktop composition system has the capability of generating content for a stereo 3D display buffer including mono content and stereo 3D content that may be rendered on a display in one or more windows. A window is a visually delineated surface dedicated to a particular user activity that is created and managed by an application. A mono application may draw mono content in a window by utilizing APIs that generate a mono application frame buffer. A stereo 3D application may draw stereo 3D graphics in a window by utilizing APIs that generate stereo 3D application frame buffers. The stereo 3D application frame buffers include left and right frame buffers that are offset by a view angle to produce the illusion of depth.

A desktop composition system incorporates the windowed contents of each application's respective frame buffers into a composition tree that represents the graphic objects that are to be displayed in each window. At each refresh cycle, the composition tree may be traversed to generate content for the stereo 3D display buffer which may be displayed in one or more windows. In an embodiment, the composition tree may be traversed twice. The first pass through the composition tree may generate content for the left display buffer and a second pass through the composition tree may generate content for the right display buffer. The areas occupied by the stereo 3D content are different in the left and right display buffers and the areas occupied by the mono content are the same in the left and right display buffers.

In another embodiment, the desktop composition system may compose content for the stereo 3D display buffer in a manner that minimizes memory and processor consumption, as well, as conserve the use of the graphics processor unit and power. The desktop composition system traverses the composition tree in a first pass to compose a left display buffer, to determine if there is any stereo 3D content, and to identify dirty rectangles when stereo 3D content is present. Upon completion of the first pass, if there is no stereo 3D content and temporary mono mode is supported, a temporary mono flag may be set that notifies the underlying hardware to ignore the right display buffer and the second pass is skipped. If temporary mono mode is not supported and there is no stereo 3D content, the dirty rectangles contributed by the mono content is copied to the right display buffer and the second pass is skipped. A second pass of the composition tree is made when the composition tree contains stereo 3D content and the right display buffer is composed considering the dirty rectangles.

Attention now turns to a more detailed description of the embodiments used in composing the stereo 3D windowed content.

A stereoscopic 3D image is an image having a depth perception. Stereo 3D images are composed of a left and right image referred to as a stereo pair. The stereo pair is offset by a view angle to produce the illusion of depth. The left and right images are sent to a display in rapid succession. Due to the inter-ocular separation between the left and right eyes, each eye sees a slight variation of the image that the human brain perceives as a depth perception. Viewing mono images on a display does not require the depth perception and as such, involves sending a succession of individual frames such that there is no distinction between what is perceived by the left eye and what is perceived by the right eye. However, for stereo 3D visualization, this distinction needs to be present which is facilitated by generating a left and right frame buffer, where the stereo 3D content in both buffers is offset by a viewing angle to produce the illusion of depth. These frame buffers need to be presented to the stereo 3D display by maintaining the alternate sequence of left and right images in order for the end user to see the stereo 3D effect.

In an embodiment, a stereo 3D image may be presented in a window that displays images or geometry that may be rendered in stereo 3D. A window is a visually delineated surface dedicated to a particular user activity that is created and managed by a software application. Each window behaves and displays its content independent of other windows or applications. A window displaying stereo 3D content is represented in the stereo 3D frame buffer.

An application outputs content to a window by writing data into an application frame buffer. An application that generates non-stereo 3D graphic content is herein referred to as a mono application and the mono application draws to a mono application frame buffer. An application that generates stereo 3D graphic content is herein referred to as a stereo 3D application and the stereo 3D application draws to a stereo 3D application frame buffer having a right display buffer and a left display buffer. Each frame buffer contains a frame of data containing pixel data, such as color values for each pixel that is displayed.

A desktop composition system creates a composite view of a desktop containing all the windows on a screen prior to the windows being rendered onto a display. Each window has a z order which is the order of the window on the desktop surface along the z-axis. The desktop composition system composes the desktop surface by drawing the desktop from the bottom up, beginning with the desktop background and proceeding through overlapping windows in a reverse z order.

In an embodiment, the desktop composition system may be implemented as the Desktop Window Manager (DWM) associated with Windows®-based operating systems. However, it should be noted that the embodiments are not constrained to this particular implementation and that the desktop composition system may be implemented in alternate configurations and supported by different operating systems. For example, the desktop composition system may reside as part of an operating system or may reside as part of other program modules that are independent of the operating system. The embodiments are not constrained in this manner.

The DWM may rely on graphics application programming interfaces (APIs), such as the DirectX® family of APIs, to provide low-level graphic services. For example, Direct2D provides vector and two-dimensional graphic processing and Direct3D® provides three-dimensional graphic capabilities. DirectX® provides an abstract interface that enables an application to generate graphic content in a window. An application may utilize the APIs to construct the application's frame buffer from which the DWM generates an appropriate display buffer tailored to accommodate the capabilities of the underlying graphics hardware. The DirectX® APIs support stereo 3D services such as enabling applications to target certain objects to the left and/or right frame buffers.

It should be noted that DirectX® is an exemplary mechanism used to generate content for frame buffers and that the embodiments are not restricted to the use of this particular mechanism, to the use of APIs, or to this particular set of APIs. The embodiments may utilize other programmable graphical services to generate content for frame buffers which may be API-based, or otherwise. The embodiments are not constrained in this manner.

FIG. 1 illustrates an exemplary system 100 for composing stereo 3D windowed content. The system 100 may include one or more applications that may generate monoscopic graphic images, referred to as mono applications 102, and/or stereo 3D graphic images, referred to as stereo 3D applications 104. These applications utilize DirectX® APIs 106 to generate a respective frame buffer. A mono application 102 generates a mono application frame buffer 108 and a stereo 3D application 104 generates a stereo 3D application frame buffer 110. Each application's frame buffer(s) may be stored in a dedicated portion of system memory.

The Desktop Window Manager 112 uses each application's frame buffer to compose a stereo 3D display 114 that is forwarded to an adapter 116 for display on a display device 118. An adapter 116 is otherwise known in the art as a video card, graphics accelerator card, graphical processing unit, and/or video adapter that interfaces with a display device 118 to output graphical images. There are various types of adapters having various capabilities. Some adapters are configured to support monoscopic displays and/or stereoscopic displays. A monoscopic display does not support stereo 3D images and a stereoscopic display supports stereo 3D images. As shown in FIG. 1, the display device 118 supports stereo 3D images and as such, the system generates a stereo 3D display buffer containing both monoscopic graphic images and stereo 3D graphic images. The display device 118 may utilize any type of display technology.

In various embodiments, the system 100 may be embedded in any type of computing device, such as a computer (e.g., server, personal computer, notebook, tablet PC, laptop, etc.), a mobile phone, a personal digital assistant, and so forth. The system 100 may have multiple components, programs, procedures, modules. As used herein these terms are intended to refer to a computer-related entity, comprising either hardware, a combination of hardware and software, or software. For example, a component can be implemented as a process running on a processor, a hard disk drive, multiple storage drives (of optical and/or magnetic storage medium), an object, an executable, a thread of execution, a program, and/or a computer. One or more components can reside within a process and/or thread of execution, and a component can be localized on one computer and/or distributed between two or more computers as desired for a given implementation. The embodiments are not limited in this manner.

The various components of system 100 may be communicatively coupled via various types of communications medium as indicated by various lines or arrows. The components may coordinate operations between each other. The coordination may involve the uni-directional or bi-directional exchange of information. For instance, the components may communicate information in the form of signals communicated over the communications medium. The information can be implemented as signals allocated to various signal lines. In such allocations, each message is a signal. Further embodiments, however, may alternatively employ data messages. Such data messages may be sent various connections. Exemplary connections include parallel interfaces, serial interfaces, and bus interfaces.

It should be noted that the component architecture depicted in FIG. 1 is that of an illustrative embodiment. The illustration is intended to illustrate functions that the embodiments may include. These functions may be distributed among a fewer or greater number of software and/or hardware components than those represented in the illustration, according to the capabilities of the platform and the desired feature set. It should also be noted that the components shown in FIG. 1 may be embodied in one or more computing devices. For example, the display device may be a separate electronic device that is communicatively coupled to the other components that are embodied in a computing device. The embodiments are not limited to a particular architecture.

Figure 2:
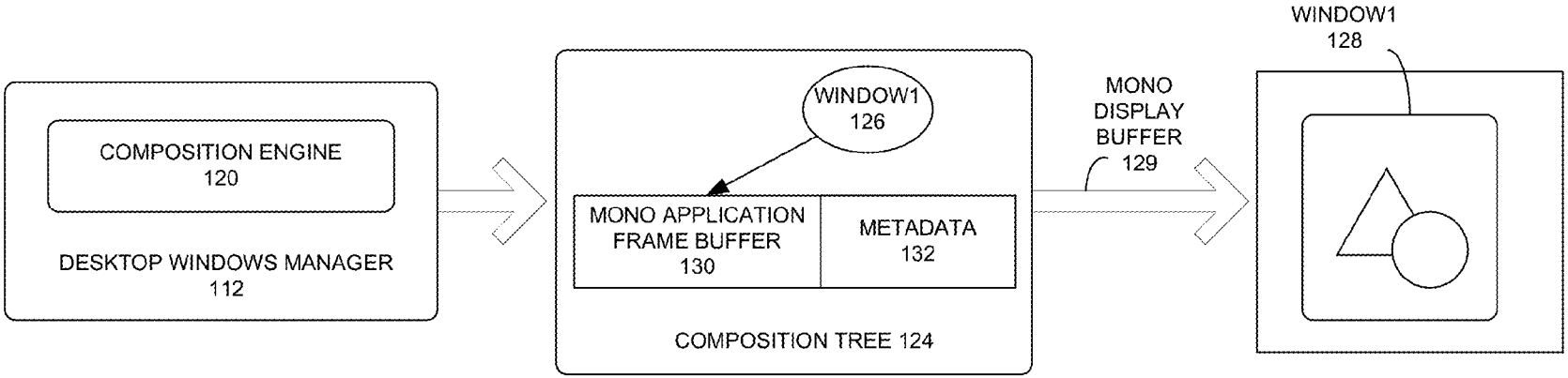
FIG. 2 is a block diagram illustrating exemplary components used in generating windowed content for a mono display buffer.

FIG. 2 is a block diagram illustrating exemplary components used to display a single window composed of monoscopic images. The Desktop Window Manager 112 may include a composition engine 120 that maintains a composition tree 124 representing a composite view of all the windows rendered on a display, referred to herein as the full screen. The composition tree 124 may contain a node 126 for each window 128. The node 126 may contain a leaf having a pointer to a memory location of the window's frame buffer 130.

The node 126 may also contain a pointer to metadata 132 associated with the window 128. The metadata 132 may include data pertaining to the window, such as the window's position, size, style, windowed content, and z order. The position is the placement of the window on the full screen, the size is the dimension of the window, the style data pertains to the graphic style used in captions, borders, and other objects used in the window, the windowed content is the graphical objects, and the z order is the window's order relative to the other windows.

The composition engine 120 updates the composition tree 124 each time an application writes to its respective frame buffer. When an application closes, the composition engine 120 deletes the node associated with the application's window from the composition tree 124. As shown in FIG. 2, there is a composition tree 124 representing a full screen having one window 128.

A composition engine 120 traverses the composition tree 124 at each refresh cycle to generate content for a mono display buffer 129 that is provided to the adapter 116 to render onto the display device. The refresh rate may be 60 Hz per second for a display device operating in mono mode and 120 Hz per second for a display device operating in stereo 3D mode.

Figure 3:
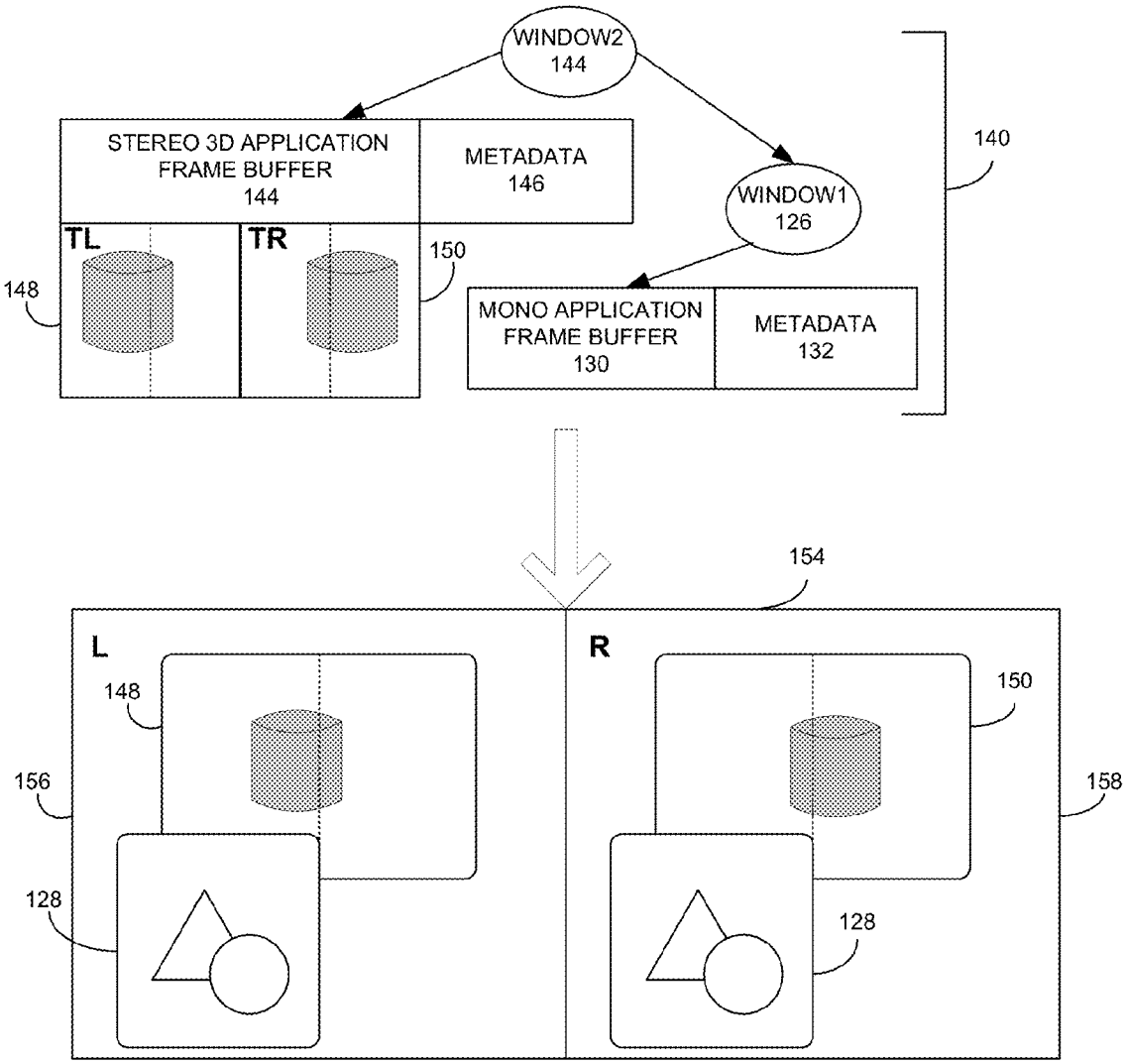
FIG. 3 is a block diagram illustrating exemplary components used in generating windowed content for a stereo 3D display buffer.

FIG. 3 is an exemplary illustration of the composition of windowed content for a stereo 3D display buffer. There is shown a composition tree 140 and a stereo 3D display buffer 158. The composition tree 140 includes two nodes where each node represents a respective window. Node 126 represents window1 having a mono application frame buffer 130 and associated metadata 132. Node 144 represents window2 having a stereo 3D application frame buffer 144 and associated metadata 146. The stereo 3D application frame buffer 144 contains a left frame buffer (TL) 150 and a right frame buffer (TR) 152.

The composition engine 120 traverses the composition tree 124 in reverse z-order, that is from window1 to window2, to generate a stereo 3D display buffer 154. The stereo 3D display buffer 154 includes a left display buffer 156 and a right display buffer 158. The composition engine 120 reads the z order information from the window's metadata to use the depth information contained therein to automatically set the layering order to place the various windows in front of and behind each other. The left display buffer 156 contains all the monoscopic images and the left stereo 3D textures of the stereo 3D images. The right display buffer 158 contains all the monoscopic images and the right stereo 3D textures of the stereo 3D images.

It should be noted that the illustration in FIG. 3 is exemplary and that the technology described herein is not limited by the illustration shown in FIG. 3. For example, each window may comprise its own composition tree with a mix of stereo 3D and mono windowed content.

Attention now turns to a more detailed discussion of operations of the embodiments with reference to various exemplary methods. It may be appreciated that the representative methods do not necessarily have to be executed in the order presented, or in any particular order, unless otherwise indicated. Moreover, various activities described with respect to the methods can be executed in serial or parallel fashion, or any combination of serial and parallel operations. The methods can be implemented using one or more hardware elements and/or software elements of the described embodiments or alternative embodiments as desired for a given set of design and performance constraints. For example, the methods may be implemented as logic (e.g., computer program instructions) for execution by a logic device (e.g., a general-purpose or specific-purpose computer).

Figure 4:
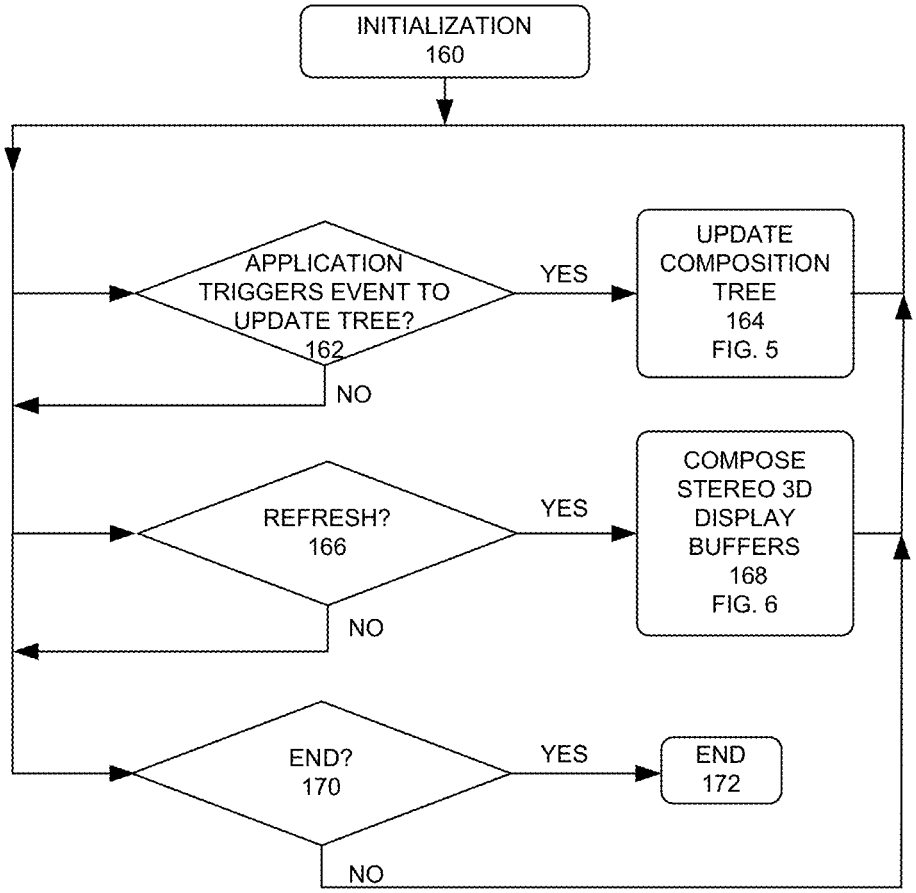
FIG. 4 is a flow chart illustrating a first exemplary method for composing stereo 3D windowed content.

FIG. 4 is a flow chart illustrating exemplary operations in composing stereo 3D windowed content. Initially, there may be an initialization stage which may occur at system boot up, restart, or the like. At this stage, the system may determine the presentation mode supported by the display and/or graphics processing unit (block 160). For example, the presentation modes may include mono mode, where no stereo 3D content is displayed, stereo 3D mode, where stereo 3D content is displayed through the Desktop Window Manager, and temporary mono mode, where the Desktop Window Manager is in stereo mode but no stereo 3D content is displayed.

Once operational, various threads of execution may be generated to perform various functions. For example, if an application triggers an event to update the composition tree (block 162—yes), the composition engine 120 may update the composition tree accordingly (block 164). If it is time to perform a refresh (block 166), the composition module 120 may generate content for a stereo 3D display buffer (block 168). If processing is terminated (block 170—yes), then all operations cease (block 172).

Figure 5:
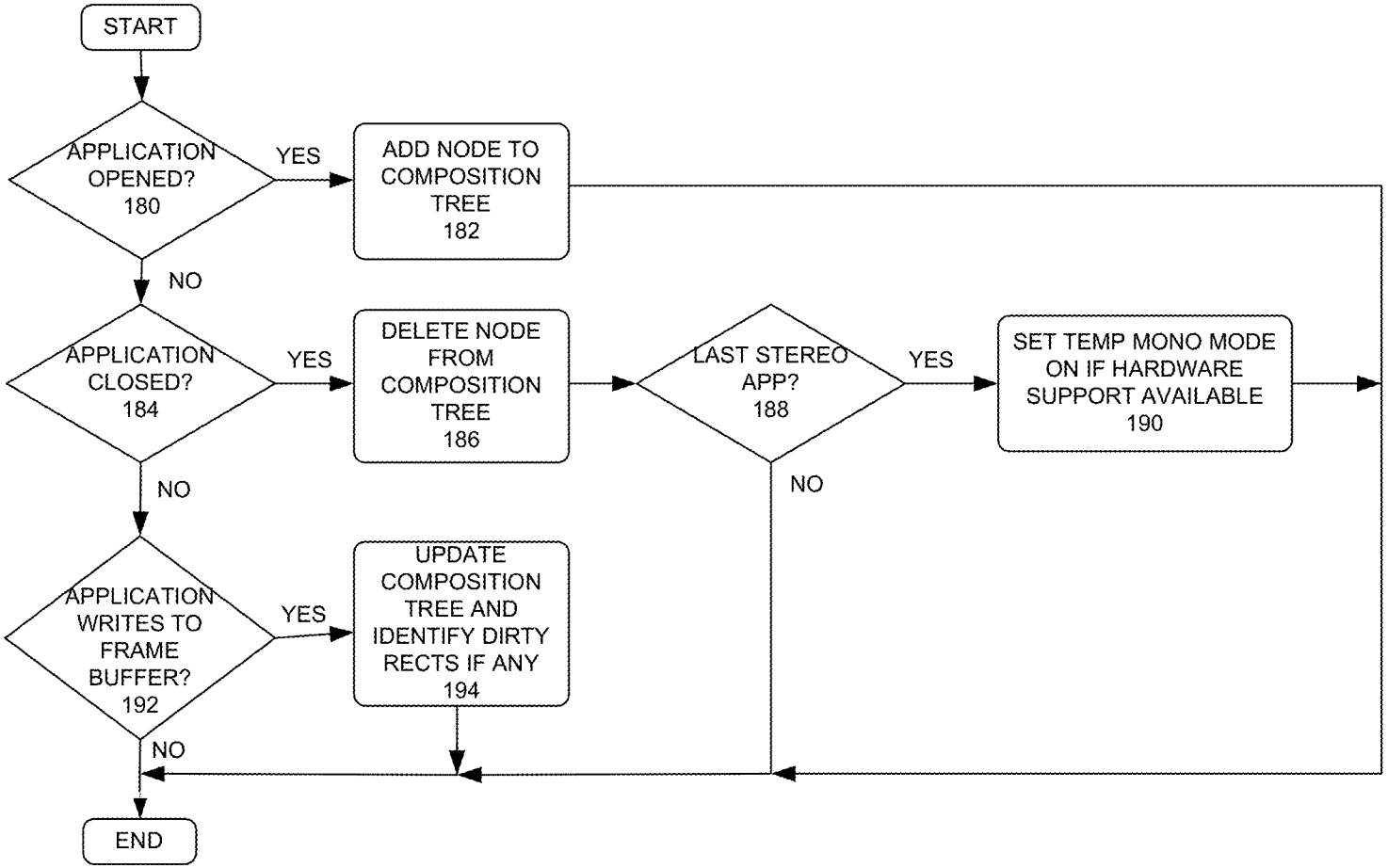
FIG. 5 is a flow chart illustrating a second exemplary method for composing stereo 3D windowed content.

FIG. 5 is a flow chart illustrating exemplary operations in maintaining the composition tree. A developer of an application may utilize the graphic APIs of DirectX® to specify the graphical user interface that may be displayed in a window. When the application opens (block 180—yes), the composition engine 120 may add a node to the composition tree 124 corresponding to the application's window (block 182). In the event an application closes (block 184—yes), the composition engine 120 deletes the node corresponding to the application's window from the composition tree 124. If the application was the last stereo 3D application (block 188—yes), a temporary mono mode indicator is set if the graphics hardware supports temporary mono mode (block 190). Otherwise (block 188—no), processing proceeds accordingly.

If the application writes data to an application frame buffer (block 192—yes), the composition engine 120 updates the composition tree 124 accordingly and identifies any dirty rectangles (block 194). A dirty rectangle is a patch of pixels whose windowed content has been modified by one or more applications and as such, are considered dirty. The composition engine 120 maintains a list of the dirty rectangles which may be used to determine which areas of an image need to be re-rendered during the second pass.

Figure 6:
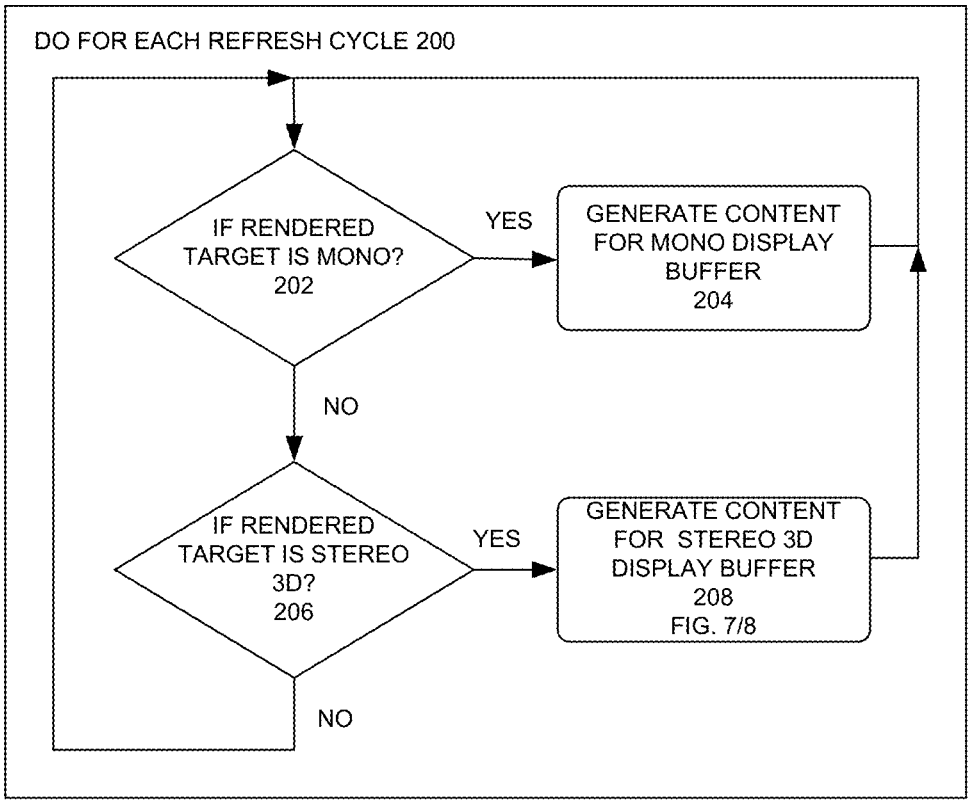
FIG. 6 is a flow chart illustrating a third exemplary method for composing stereo 3D windowed content.

FIG. 6 is a flow chart illustrating exemplary operations in creating a stereo 3D display buffer at each refresh cycle. At each refresh cycle (block 200), the Desktop Window Manager 112 may generate a mono display buffer or a stereo 3D display buffer. If the render target, such as the display device, supports mono mode (block 202—yes), content for the mono display buffer may be generated (block 204). The composition module 120 traverses the composition tree 124 and generates content for the mono display buffer utilizing the mono and/or stereo 3D content contained therein. Stereo 3D content may be included in the mono display buffer from only one of the frame buffers, left or right, depending on the application's preference.

Figure 7:
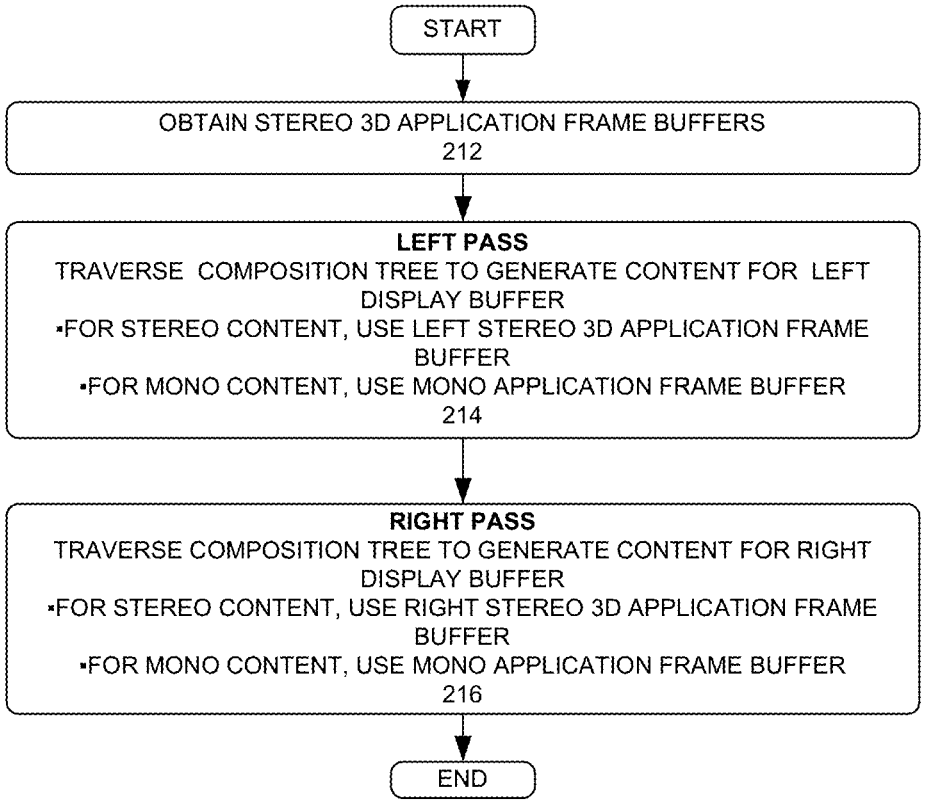
FIG. 7 is a flow chart illustrating a fourth exemplary method for composing stereo 3D windowed content.

If the render target supports stereo 3D mode (block 206—yes), content for a stereo 3D display buffer may be generated (block 208). Turning to FIG. 7, there is shown a first exemplary embodiment for generating content to a stereo 3D display buffer. In this exemplary embodiment, a stereo 3D application writes to a stereo 3D application frame buffer. The composition engine 120 obtains the content from the newly added stereo 3D application frame buffer (block 212). Then, the composition module 120 then makes two passes, a left pass and a right pass, through the composition tree 124.

It should be noted that although the description refers to the first pass or traversal of the composition tree as the left pass and the second pass or traversal of the composition tree as the right pass, the embodiments are not limited to the first pass composing the left display buffer and the second pass composing the right display buffer. The first pass may compose the right display buffer and the second pass may compose the left display buffer. The order of the composition of a display buffer is a matter of implementation and not a limitation on the embodiments.

In an embodiment, the first or left pass generates the content for the left display buffer and the second or right pass generates the content for the right display buffer. The composition engine 120 may traverse the composition tree 124 in reverse z-order generating windowed content for the left display buffer (block 214). If a node of the composition tree 124 represents mono content, content is taken from the entire mono application frame buffer and when a node of the composition tree 124 represents stereo 3D content, only the left frame buffer is copied to the left display buffer (block 214).

During the second pass, the composition engine 120 traverses the composition tree 124 in reverse z-order to generate content for the right display buffer (block 216). If the node of the composition tree 124 represents stereo 3D content, content for the right display buffer may be generated (block 216). If the node of the composition tree represents mono content, content is taken from the entire mono application frame buffer (block 216). At the end of the completion of the second pass, the content for the stereo 3D display buffer may be generated.

In an embodiment, the system keeps stereo mode support active when stereo support is available even though there may not be a stereo 3D application currently executing. This may be done in order to minimize screen flickers which may occur when switching from mono mode to stereo 3D mode. The screen flickers may occur when stereo 3D applications are launched by the end user and the system was in mono mode. Stereo 3D mode support consumes considerable amount of power and consumes a large portion of processor and memory utilization. For example, in stereo 3D mode, the memory needed to render a target frame buffer is twice as much as in mono mode. The frame buffers are a section of contiguously allocated memory for both the left and right images of a stereo 3D image. In addition, the memory bandwidth is reduced since twice the amount of frame data is being transmitted in the system. The power utilization increases with the increased memory utilization and the faster refresh rate. In stereo 3D mode, the refresh rate for displays and/or panels having stereoscopic support may be 120 Hz which consumes additional power than the 60 Hz refresh rate associated with mono mode.

In a second embodiment, the Desktop Window Manager creates a stereo 3D display buffer in a manner that minimizes resource consumption and utilization. In particular, the first pass of the composition tree generates content for the left display buffer, generates several lists of dirty rectangles, and determines whether or not there is stereo 3D content. In particular, a list of dirty rectangles may be made for the stereo 3D content, a list of dirty rectangles may be made for the intersecting stereo 3D content, and a list of dirty rectangles may be made for the mono content that has changed.

Upon completion of the first pass, the content bounded by the list of dirty rectangles contributed by the mono content is copied from the left display buffer to the right display buffer. If there is no stereo 3D content, then there is no need to generate the content for the right display buffer and the process finishes. If there is no stereo 3D content and the render target supports temporary mono mode, the temp mono flag is set to indicate to the graphics processing unit to ignore the contents of the right display buffer.

If there is stereo 3D content, then the lists of dirty rectangles may be used to determine which areas of a window are copied, thereby conserving resource consumption, and which areas of a window need to be re-rendered. If there was stereo 3D content, a second pass is made. The list of dirty rectangles made for the stereo 3D content and the intersection stereo 3D content is re-rendered onto the right display buffer. In this manner, the area re-rendered may be smaller than the total area rendered in the first pass.

Figure 8:
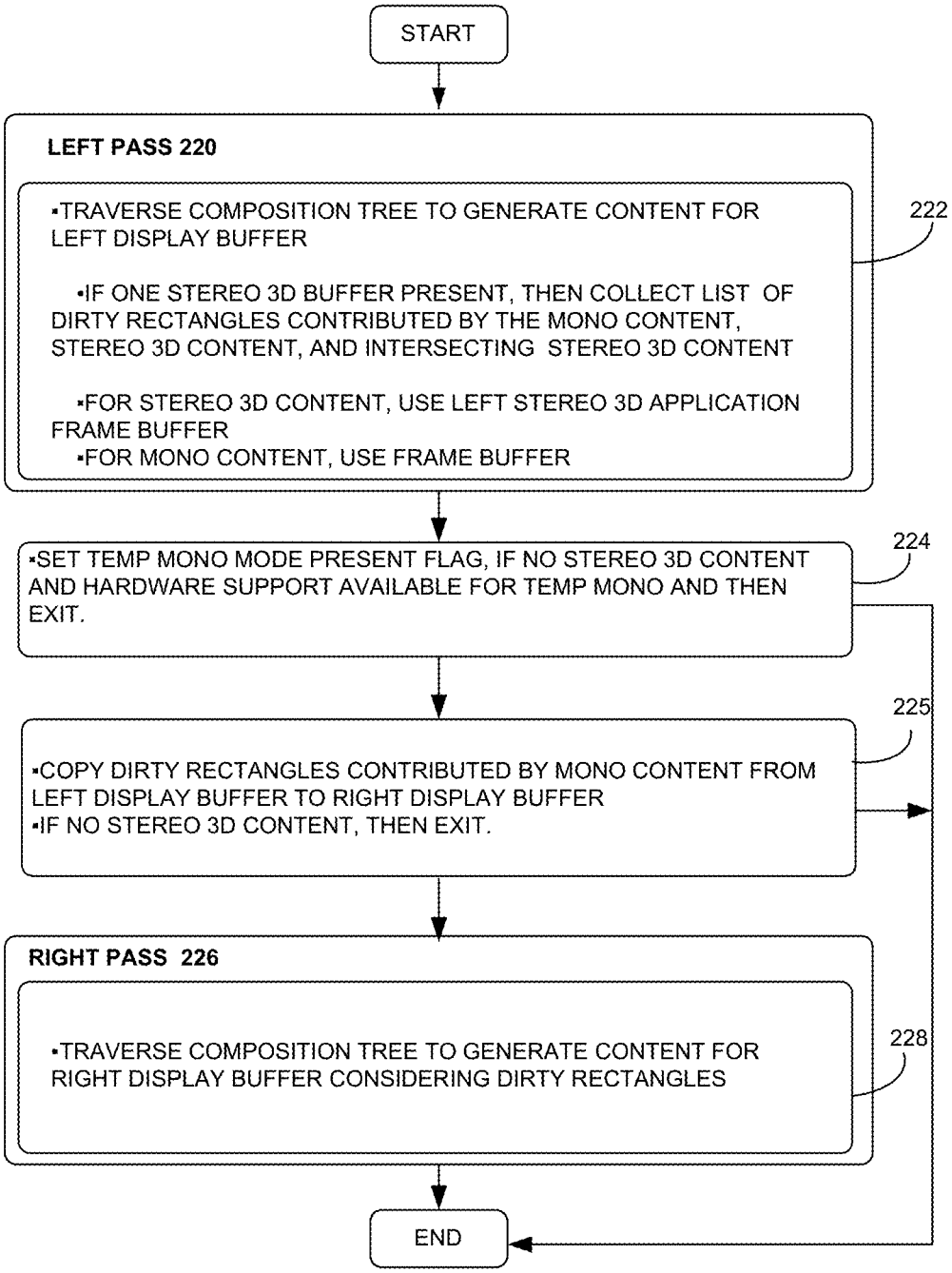
FIG. 8 is a flow chart illustrating a fifth exemplary method for composing stereo 3D windowed content.

Referring to FIG. 8, the composition engine 120 starts with making a left pass through the composition tree (block 220). As the composition tree is traversed, the lists of dirty rectangles contributed by the mono content, the stereo 3D content, and the intersecting stereo 3D content are made (block 222). In addition, if a node in the composition tree contains stereo 3D content, content from the left frame buffer is generated onto the left display buffer (block 222). If a node in the composition tree contains mono content, content from the entire mono application frame is generated onto the left display buffer (block 222).

At the completion of the left pass, if there is no stereo 3D content in the composition tree, then the composition module 120 determines whether or not it is possible to utilize the stereo 3D display buffer if the current processing mode is set to stereo mode (block 224). If the underlying graphics hardware, such as the adaptor, is configured to support temporary mono mode and there is no stereo 3D content in the composition tree, temporary mono mode is an optimization that may be made to reduce processing and conserve resource consumption. In temporary mono mode, the stereo 3D display buffer is utilized where only the left display buffer is used to render a window (block 224). A temporary mono mode present flag is activated which informs the adapter to ignore the content in the right display buffer and processing for the right pass is skipped (block 224).

In the first pass through the composition tree, the list of dirty rectangles is identified from the metadata associated with each window. The list of dirty rectangles contributed by the mono content is used to copy the dirty rectangles onto the right display buffer without re-rendering these areas. The list of dirty rectangles contributed by the stereo 3D content and the intersection of the stereo 3D content is used in the right pass to identify regions in windows that need to be redrawn. Next, the dirty rectangle regions contributed by mono content may be copied from the left display buffer to the right display buffer (block 225). If there is no stereo 3D content, then the process ends (block 225).

Next, the right pass through the composition tree may be made (block 226). As the composition tree is traversed to re-render the dirty rectangles contributed by the stereo 3D content and the intersecting stereo 3D content (block 228). At the completion of the right pass, the stereo 3D display buffer is generated which is rendered onto a display.

Figure 9:
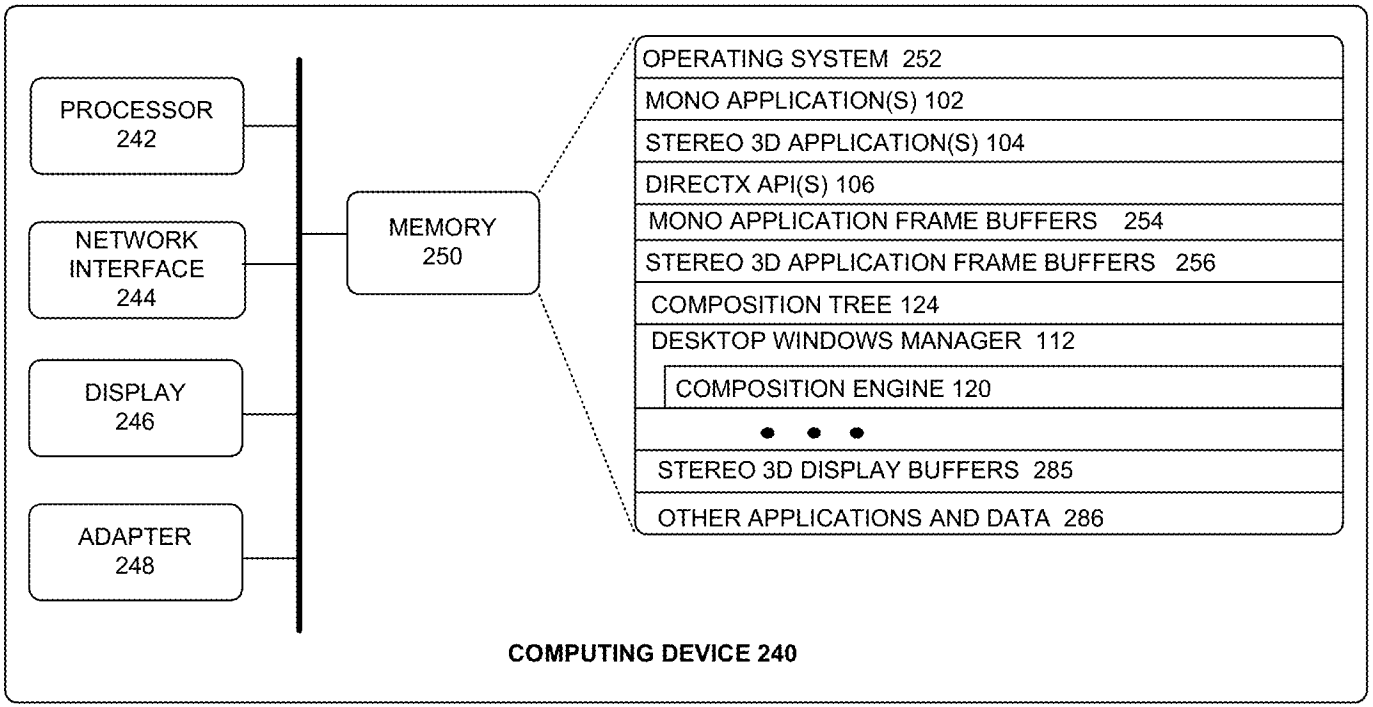
FIG. 9 is a block diagram illustrating an operating environment.

Attention now turns to an exemplary operating environment. Referring now to FIG. 9, there is shown a schematic block diagram of an exemplary operating environment. The operating environment may include a computing device 240 embodied as a hardware device, such as without limitation, a computer (e.g., server, personal computer, laptop, etc.), a cell phone, a personal digital assistant, or any type of computing device, and the like. The computing device 240 may have a processor 242, a network interface 244, a display 246, an adapter 248, and a memory 250. The processor 242 may be any commercially available processor and may include dual microprocessors and multi-processor architectures. The network interface 244 facilitates wired or wireless communications between the computing device 240 and a communications framework.

The memory 250 may be any computer-readable storage media or computer-readable media that may store processor-executable instructions, procedures, applications, and data. The computer-readable media does not pertain to propagated signals, such as modulated data signals transmitted through a carrier wave. It may be any type of memory device (e.g., random access memory, read-only memory, etc.), magnetic storage, volatile storage, non-volatile storage, optical storage, DVD, CD, floppy drive, disk drive, flash memory, and the like. The memory 250 may also include one or more external storage devices or remotely located storage devices. The memory 250 may contain instructions and data as follows:

an operating system 252;
one or more mono applications 102;
one or more stereo 3D applications 104;
one or more DirectX APIs 106;
mono application frame buffers 254;
stereo 3D application frame buffers 256;
a composition tree 124;
a Desktop Window Manager 112 having a composition engine 120;
stereo 3D display buffers 285; and
various other applications and data 286.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

For example, various embodiments of the system may be implemented using hardware elements, software elements, or a combination of both. Examples of hardware elements may include devices, components, processors, microprocessors, circuits, circuit elements, integrated circuits, application specific integrated circuits, programmable logic devices, digital signal processors, field programmable gate arrays, memory units, logic gates and so forth. Examples of software elements may include software components, programs, applications, computer programs, application programs, system programs, machine programs, operating system software, middleware, firmware, software modules, routines, subroutines, functions, methods, procedures, software interfaces, application program interfaces, instruction sets, computing code, code segments, and any combination thereof. Determining whether an embodiment is implemented using hardware elements and/or software elements may vary in accordance with any number of factors, such as desired computational rate, power levels, bandwidth, computing time, load balance, memory resources, data bus speeds and other design or performance constraints, as desired for a given implementation.

Some embodiments may comprise a storage medium to store instructions or logic. Examples of a storage medium may include one or more types of computer-readable storage media capable of storing electronic data, including volatile memory or non-volatile memory, removable or non-removable memory, erasable or non-erasable memory, writeable or re-writeable memory, and so forth. Examples of the logic may include various software components, such as programs, procedures, module, applications, code segments, program stacks, middleware, firmware, methods, routines, and so on. In an embodiment, for example, a computer-readable storage medium may store executable computer program instructions that, when executed by a processor, cause the processor to perform methods and/or operations in accordance with the described embodiments. The executable computer program instructions may be implemented according to a predefined computer language, manner or syntax, for instructing a computer to perform a certain function. The instructions may be implemented using any suitable high-level, low-level, object-oriented, visual, compiled and/or interpreted programming language.

Although the technology described herein has referenced components associated with the Windows® operating system, the embodiments herein are not limited or tied to any particular operating system. The embodiments described herein may be applied to OpenGL components and any other graphics systems in addition to Linux and MAC based operating systems. In addition, the technology described above refers to the Microsoft Desktop Window Manager which is an exemplary application that provides the composition services. However, the embodiments are not limited to the use of this particular application and other composition services, systems and applications may be utilized for an intended implementation.

What is claimed:

1. A method, comprising:

obtaining content from a mono application frame buffer associated with a first window and content from a stereo 3D application frame buffer associated with a second window, the first window including a surface area managed by a mono application, the second window including a surface area managed by a stereo 3D application;

composing a stereo 3D display buffer including the content from the mono application frame buffer and the content from the stereo 3D application frame buffer, the stereo 3D display buffer having a left frame buffer and a right frame buffer;

ascertaining whether a target display device supports temporary mono mode; and upon determining that the second window does not have stereo 3D content and the target display device supports temporary mono mode, rendering content from only the left frame buffer.

2. The method of claim 1, further comprising:

establishing that the target display device does not support temporary mono mode; and upon determining that the second window does not have stereo 3D content, copying dirty rectangles contributed by the content from the mono application frame buffer to the right frame buffer of the stereo 3D display buffer.

3. The method of claim 1, further comprising:

establishing that the target display device supports stereo 3D mode;

determining that the second window includes stereo 3D content;

collecting dirty rectangles from the content from the mono application frame buffer, the content from the stereo 3D application, and intersecting stereo 3D content associated with the first window and the second window; and composing the right frame buffer based on the collected dirty rectangles.

4. The method of claim 3, wherein the collected dirty rectangles identify regions in the first window and the second window that need to be redrawn.

5. The method of claim 1, wherein the stereo 3D display buffer represents a composite view of a desktop surface of the first window and the second window viewed on a display device.

6. The method of claim 1, wherein composing the stereo 3D display buffer is performed at one or more refresh cycles.

7. A device, comprising:

at least one processor and a memory;

the at least one processor configured to:

obtain a composition tree representing at least one window, the at least one window including mono content or stereo 3D content;

when the composition tree has stereo 3D content, traverse the composition tree in a first pass to generate a list of dirty rectangles contributed by one or more of the mono content, the stereo 3D content and intersecting stereo 3D content;

compose a left 3D display buffer from one or more of the stereo 3D content and the mono content; and upon determining that the composition tree includes a window having stereo 3D content, generate content for a right 3D display buffer using the list of dirty rectangles.

8. The device of claim 7, wherein the at least one processor is further configured to:

upon determining that the composition tree does not include a window having stereo 3D content, rendering content from only the left 3D display buffer when a target device supports temporary mono mode.

9. The device of claim 7, wherein the at least one processor is further configured to:

upon determining that the composition tree does not include a window having stereo 3D content, copy dirty rectangles contributed by the mono content to the right 3D display buffer.

10. The device of claim 7, wherein prior to generating content for the right 3D display buffer, copying dirty rectangles contributed to by the mono content to the right 3D display buffer.

11. The device of claim 10, wherein the at least one processor is further configured to use the dirty rectangles contributed by the stereo 3D content and the intersecting stereo 3D content to generate additional content to the right 3D display buffer.

12. The device of claim 7, wherein the mono content is managed by a mono application and the stereo 3D content is managed by a stereo 3D application.

13. The device of claim 7, wherein the stereo 3D display buffer is composed at each refresh cycle.

14. A system, comprising:

at least one processor and a memory;

a stereo 3D display buffer having a left frame buffer and a right frame buffer;

a display device;

an adapter configured to render the stereo 3D display buffer onto the display device;

the memory including:

a composition tree representing a plurality of windows, each window including mono content or stereo 3D content; and a composition engine configured to:

traverse the composition tree in a first pass to generate content for the left frame buffer and to determine if the composition tree includes a window having stereo 3D content; and generate content for the right frame buffer;

wherein the adapter ignores the right frame buffer when the display device supports temp mono mode and the composition tree does not include stereo 3D content.

15. The system of claim 14, wherein the composition engine is further configured to:

generate a list of dirty rectangles contributed by the mono content; and use the list of dirty rectangles contributed by the mono content to generate the content for the right frame buffer.

16. The system of claim 14, wherein the composition engine is further configured to set a temp mono mode flag when the display device supports temp mono mode and there is no stereo 3D content in the composition tree, and wherein the adapter ignores the contents of the right frame buffer when the temp mono mode flag is set.

17. The system of claim 14, wherein traversal of the composition tree in the first pass further comprises collecting a list of dirty rectangles contributed by the mono content, the stereo 3D content and intersecting stereo 3D content, and wherein generate content for the right frame buffer uses the list of dirty rectangles to re-render portions of a modified window.

18. The system of claim 14, wherein the mono content is stored in a mono application frame buffer managed by a mono application.

19. The system of claim 14, wherein the stereo 3D content is stored in a stereo 3D application frame buffer that is managed by a stereo 3D application.

20. The system of claim 14, wherein a window is associated with an application that generates content for display in the window.

* * * * *